US009915136B2

(12) United States Patent
Eisaman et al.

(10) Patent No.: US 9,915,136 B2
(45) Date of Patent: Mar. 13, 2018

(54) HYDROCARBON EXTRACTION THROUGH CARBON DIOXIDE PRODUCTION AND INJECTION INTO A HYDROCARBON WELL

(71) Applicant: X Development LLC, Mountain View, CA (US)

(72) Inventors: Matthew D. Eisaman, Port Jefferson, NY (US); Kathleen E. Cooper, Palo Alto, CA (US)

(73) Assignee: X Development LLC, Mountain View, CA (US)

( * ) Notice: Subject to any disclaimer, the term of this patent is extended or adjusted under 35 U.S.C. 154(b) by 0 days.

(21) Appl. No.: 15/165,311

(22) Filed: May 26, 2016

(65) Prior Publication Data

US 2017/0342813 A1 Nov. 30, 2017

(51) Int. Cl.
*E21B 43/16* (2006.01)
*C25B 7/00* (2006.01)

(52) U.S. Cl.
CPC ..... *E21B 43/164* (2013.01); *C25B 7/00* (2013.01)

(58) Field of Classification Search
CPC ..... E21B 43/164; C05B 7/00
USPC ..... 166/305.1
See application file for complete search history.

(56) References Cited

U.S. PATENT DOCUMENTS 3,075,828 A 1/1963 Kato et al.
4,036,749 A 7/1977 Anderson
4,392,959 A 7/1983 Coillet
6,905,606 B1 6/2005 Kikuyama et al.
7,117,106 B2 10/2006 Rusta-Sallehy et al.
7,198,722 B2 4/2007 Hussain
7,655,193 B1 2/2010 Rau et al.
7,700,214 B1 4/2010 Iyer et al.
7,790,012 B2 * 9/2010 Kirk ..... B01D 53/326 204/263
7,906,028 B2 3/2011 Constantz et al.
7,931,809 B2 4/2011 Constantz et al.
7,947,239 B2 5/2011 Lackner et al.
8,227,127 B2 7/2012 Little et al.
(Continued)

FOREIGN PATENT DOCUMENTS

CN 102936067 A 2/2013
EP 1276795 3/2006
(Continued)

OTHER PUBLICATIONS

Eisaman M. D. et al., CO2 separation using bipolar membrane electrodialysis, Energy & Environmental Science, Apr. 2011, 10 pages.

(Continued)

*Primary Examiner* — Silvana C Runyan
(74) *Attorney, Agent, or Firm* — Christensen O'Connor Johnson Kindness PLLC

(57) ABSTRACT

A method of extracting hydrocarbons from a hydrocarbon well includes receiving an aqueous solution including dissolved inorganic carbon, and extracting the dissolved inorganic carbon from the aqueous solution to create $CO_2$ by changing a pH of the aqueous solution. The method also includes pumping the $CO_2$ into the hydrocarbon well and, in response to pumping the $CO_2$ into the hydrocarbon well, extracting the hydrocarbons from the hydrocarbon well.

16 Claims, 4 Drawing Sheets

(56) References Cited

U.S. PATENT DOCUMENTS

| | | | | |
|---|---|---|---|---|
| 8,313,557 | B2 | 11/2012 | Willauer et al. | |
| 8,337,589 | B2 | 12/2012 | Wright et al. | |
| 8,685,250 | B2 | 4/2014 | Choi et al. | |
| 8,778,156 | B2 | 7/2014 | Eisaman et al. | |
| 8,784,632 | B2 | 7/2014 | Eisaman et al. | |
| 8,936,700 | B2 | 1/2015 | Newman et al. | |
| 8,999,171 | B2 | 4/2015 | Wallace | |
| 9,227,168 | B1 | 1/2016 | DeVaul et al. | |
| 2005/0074657 | A1 | 4/2005 | Rusta-Sallehy et al. | |
| 2008/0031801 | A1 | 2/2008 | Lackner et al. | |
| 2008/0033338 | A1 | 2/2008 | Smith | |
| 2008/0093307 | A1 | 4/2008 | Somers et al. | |
| 2009/0001020 | A1 | 1/2009 | Constantz et al. | |
| 2010/0028242 | A1 | 2/2010 | Willauer et al. | |
| 2010/0233767 | A1 | 9/2010 | McMurran | |
| 2010/0288700 | A1 | 11/2010 | Lahav et al. | |
| 2011/0056876 | A1 | 3/2011 | Ide et al. | |
| 2011/0135551 | A1 | 6/2011 | House et al. | |
| 2011/0174507 | A1 | 7/2011 | Burnham et al. | |
| 2011/0177550 | A1 | 7/2011 | McMurran | |
| 2011/0224578 | A1 | 9/2011 | Edman et al. | |
| 2011/0226006 | A1 | 9/2011 | Lackner et al. | |
| 2011/0237839 | A1 | 9/2011 | Waldstein | |
| 2011/0281959 | A1 | 11/2011 | DiMascio et al. | |
| 2012/0211421 | A1 | 8/2012 | Self et al. | |
| 2012/0220019 | A1 | 8/2012 | Lackner | |
| 2012/0244053 | A1 | 9/2012 | Self et al. | |
| 2013/0008792 | A1 | 1/2013 | Eisaman et al. | |
| 2013/0034760 | A1 | 2/2013 | Otts et al. | |
| 2013/0036748 | A1 | 2/2013 | Lewis | |
| 2013/0206605 | A1 | 8/2013 | DiMascio et al. | |
| 2013/0281553 | A1 | 10/2013 | Kubic et al. | |
| 2013/0343981 | A1 | 12/2013 | Wright et al. | |
| 2014/0002788 | A1 | 1/2014 | Otts et al. | |
| 2014/0217024 | A1 | 8/2014 | Monzyk et al. | |
| 2014/0234735 | A1 | 8/2014 | Zhang et al. | |
| 2014/0238869 | A1 | 8/2014 | DiMascio et al. | |
| 2014/0272639 | A1 | 9/2014 | Zietlow | |
| 2014/0303452 | A1 | 10/2014 | Ghaffari | |
| 2014/0322803 | A1 | 10/2014 | Constantz et al. | |
| 2014/0338903 | A1 | 11/2014 | Mahmoud et al. | |
| 2015/0246314 | A1* | 9/2015 | Constantz ..... | B01D 53/62 423/220 |
| 2015/0274536 | A1 | 10/2015 | Wright et al. | |
| 2015/0298806 | A1 | 10/2015 | Lind et al. | |
| 2016/0082387 | A1 | 3/2016 | Constantz et al. | |

FOREIGN PATENT DOCUMENTS

| | | |
|---|---|---|
| EP | 2074066 | 7/2009 |
| EP | 2465600 | 6/2012 |
| EP | 2465601 | 6/2012 |
| EP | 2543427 | 1/2013 |
| WO | WO 9412465 | 6/1994 |
| WO | WO 2010/142943 A2 | 12/2010 |
| WO | WO 2011/090376 A1 | 7/2011 |

OTHER PUBLICATIONS

U.S. Appl. No. 14/971,122—Electrodialytic CO2 Purification and Stripping, filed Dec. 16, 2015, 16 pages U.S. Appl. No. 14/736,847—Energy Efficient Method for Stripping CO2 From Seawater, filed Jun. 11, 2015, 16 pages.

U.S. Appl. No. 14/750,800—CO2 Sequestration Via Desalination, filed Jun. 25, 2015, 16 pages.

Willauer, H. D. et al., Extraction of Carbon Dioxide from Seawater by an Electrochemical Acidification Cell. Part 2 —Laboratory Scaling Studies, Apr. 2011, 22 pages.

Eisaman M. D. et al., CO2 extraction from seawater using bipolar membrane electrodialysis, May 2012, 8 pages.

Biorock International Coral Reef Restoration, Biorock International Corporation, 2012, 2 pages.

Rangel C. M. et al., Integrating hydrogen generation and storage in a novel compact electrochemical system based on metal hydrides, Jul. 2008, 5 pages.

U.S. Appl. No. 62/342,061—Method for Efficient CO2 Degasification, filed May 26, 2016, 23 pages.

U.S. Appl. No. 15/165,867—Method for Feeding Algae Using Reclaimed CO2, filed May 26, 2016, 19 pages.

U.S. Appl. No. 15/165,885—Metal Hydride Electrolysis System, filed May 26, 2016, 21 pages.

U.S. Appl. No. 62/342,065—Chemical Extraction From an Aqueous Solution, filed May 26, 2016, 29 pages.

U.S. Appl. No. 15/165,205—Chemical Extraction From an Aqueous Solution and Power Generator Cooling, filed May 26, 2016, 30 pages.

U.S. Appl. No. 15/165,260—Building Materials From an Aqueous Solution, filed May 26, 2016, 29 pages.

U.S. Appl. No. 15/165,357—Fuel Synthesis From an Aqueous Solution, filed May 26, 2016, 31 pages.

International Application No. PCT/US2017/032217—International Search Report and Written Opinion dated Aug. 10, 2017, 15 pages.

* cited by examiner

HYDROCARBON EXTRACTION THROUGH CARBON DIOXIDE PRODUCTION AND INJECTION INTO A HYDROCARBON WELL

TECHNICAL FIELD

This disclosure relates generally to hydrocarbon extraction.

BACKGROUND INFORMATION

Pure carbon dioxide ($CO_2$) has many industrial uses. The separation of $CO_2$ from a mixed-gas source may be accomplished by a capture and regeneration process. More specifically, the process generally includes a selective capture of $CO_2$, by, for example, contacting a mixed-gas source with a solid or liquid adsorber/absorber followed by a generation or desorption of $CO_2$ from the adsorber/absorber. One technique describes the use of bipolar membrane electrodialysis for $CO_2$ extraction/removal from potassium carbonate and bicarbonate solutions.

For capture/regeneration systems, a volume of gas that is processed is generally inversely related to a concentration of $CO_2$ in the mixed-gas source, adding significant challenges to the separation of $CO_2$ from dilute sources such as the atmosphere. $CO_2$ in the atmosphere, however, establishes equilibrium with the total dissolved inorganic carbon in the oceans, which is largely in the form of bicarbonate ions ($HCO_3$—) at an ocean pH of 8.1-8.3. Therefore, a method for extracting $CO_2$ from the dissolved inorganic carbon of the oceans would effectively enable the separation of $CO_2$ from atmosphere without the need to process large volumes of air.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. The drawings are not necessarily to scale, emphasis instead being placed upon illustrating the principles being described.

DETAILED DESCRIPTION

Embodiments of an apparatus and method for enhanced hydrocarbon extraction are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Throughout the specification and claims, compounds/elements are referred to both by their chemical name (e.g., carbon dioxide) and chemical symbol (e.g., $CO_2$). It is appreciated that both chemical names and symbols may be used interchangeably and have the same meaning.

This disclosure provides for the removal of carbon from water sources containing dissolved inorganic carbon (e.g., bicarbonate ions $HCO_3$—), converting the dissolved carbon into dissolved $CO_2$ gas, stripping the $CO_2$ gas from the water source, and using the $CO_2$ to extract oil or natural gas from hydrocarbon wells. Enhanced oil recovery (EOR) is a method for extracting additional fossil fuel from an existing well by injecting $CO_2$ into the well to displace and eject hydrocarbons. The economic potential for EOR in nearshore and offshore wells is enormous. Using $CO_2$ extracted from the ocean to remove hydrocarbons from existing oil wells may be more environmentally friendly than drilling a new well. $CO_2$ from the ocean is sequestered in the existing well to help offset the hydrocarbons extracted. In addition, the alkalinity of the decarbonized seawater is restored by addition of NaOH prior to returning the water to the ocean, resulting in reabsorption of $CO_2$ from the atmosphere into the parcel of returned water. Further, there is no need to drill a new well, limiting further environmental damage and reducing the chance of drilling accidents.

Figure 1A:
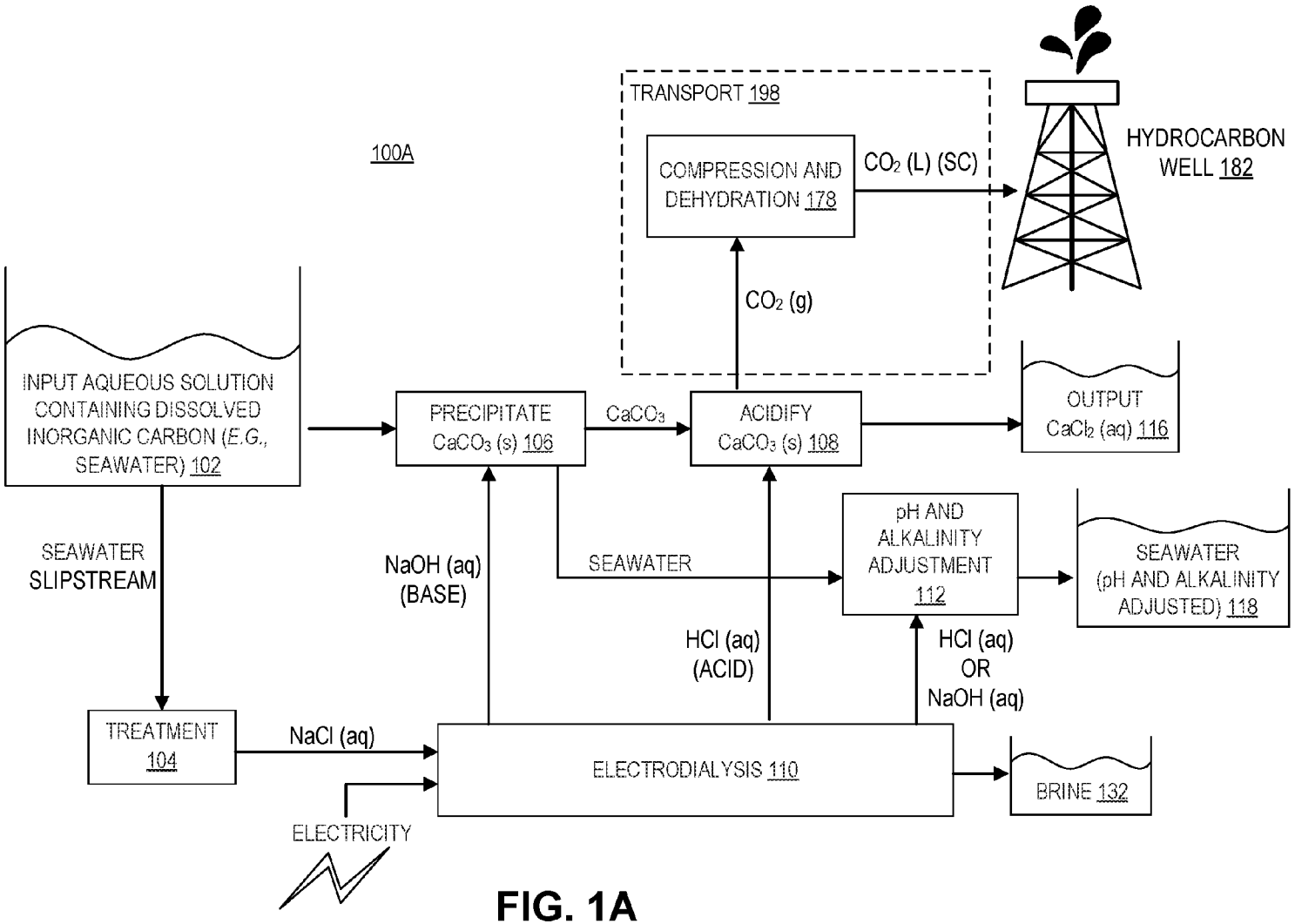
FIG. 1A is an illustration of a system for extracting hydrocarbons from a hydrocarbon well, in accordance with an embodiment of the disclosure.

FIG. 1A is an illustration of system 100A for extracting hydrocarbons from hydrocarbon well 182, in accordance with an embodiment of the disclosure. System 100A includes: input 102 (to input an aqueous solution containing dissolved inorganic carbon), treatment unit 104, precipitation unit 106, acidification unit 108, electrodialysis unit 110, pH and alkalinity adjustment unit 112, $CaCl_2$ output 116, water output 118, brine output 132, transport system 198 (including compression and dehydration unit 178), and hydrocarbon well 182.

As shown, input 102 is coupled to a water reservoir containing dissolved inorganic carbon (e.g., bicarbonate ions). The water reservoir may be an ocean, lake, river, manmade reservoir, or brine outflow from a reverse osmosis ("RO") process. Input 102 may receive the water through a system of channels, pipes, and/or pumps depending on the specific design of the facility. As shown, water received through input 102 is diverted into two separate sections of system 100A. A first (smaller) portion of the water is diverted to treatment unit 104, while a second (larger) portion of the water is diverted to precipitation unit 106. One skilled in the art will appreciate that large aggregate may be removed from the water at any time during the intake process.

In the illustrated embodiment, the first portion of water is diverted into treatment unit 104. Treatment unit 104 outputs a relatively pure stream of aqueous NaCl. In other words, an aqueous solution (possibly including seawater) is input to treatment unit 104, and aqueous NaCl is output from treatment unit 104. Treatment unit 104 may be used to remove organic compounds and other minerals (other than NaCl) not needed in, or harmful to, subsequent processing steps. For example, removal of chemicals in the water may mitigate scale buildup in electrodialysis unit 110. Treatment unit 104 may include filtering systems such as: nanofilters, RO units, ion exchange resins, precipitation units, microfilters, screen filters, disk filters, media filters, sand filters, cloth filters, and biological filters (such as algae scrubbers), or the like. Additionally, treatment unit 104 may include chemical filters to removed dissolved minerals/ions. One skilled in the art will appreciate that any number of screening and/or filtering methods may be used by treatment unit 104 to remove materials, chemicals, aggregate, biologicals, or the like.

Electrodialysis unit 110 is coupled to receive aqueous NaCl and electricity, and output aqueous HCl, aqueous NaOH, and brine (to brine output 132). Aqueous HCl and aqueous NaOH output from electrodialysis unit 110 may be used to drive chemical reactions in system 100A. The specific design and internal geometry of electrodialysis unit 110 is discussed in greater detail in connection with FIG. 2 (see infra FIG. 2). Brine output from electrodialysis unit 110 may be used in any applicable portion of system 100A. For example, brine may be cycled back into electrodialysis unit 110 as a source of aqueous NaCl, or may be simply expelled from system 100A as wastewater.

In the illustrated embodiment, precipitation unit 106 has a first input coupled to receive an aqueous solution including dissolved inorganic carbon (e.g., seawater) from input 102. Precipitation unit 106 also has a second input coupled to electrodialysis unit 110 to receive aqueous NaOH. In response to receiving the aqueous solution and the aqueous NaOH, precipitation unit 106 precipitates calcium salts (for example, but not limited to, $CaCO_3$) and outputs the aqueous solution. However, in other embodiments, other chemical processes may be used to basify the aqueous solution in precipitation unit 106. For example, other bases (not derived from the input aqueous solution) may be added to the aqueous solution to precipitate calcium salts.

In one embodiment, NaOH is added to incoming seawater until the pH is sufficiently high to allow precipitation of calcium salts without significant precipitation of $Mg(OH)_2$. The exact pH when precipitation of $CaCO_3$ occurs (without significant precipitation of $Mg(OH)_2$) will depend on the properties of the incoming seawater (alkalinity, temperature, composition, etc.); however, a pH of 9.3 is typical of seawater at a temperature of 25° C. In a different embodiment, the quantity of NaOH added is sufficient to precipitate $CaCO_3$ and $Mg(OH)_2$, then the pH is lowered (e.g., by adding HCl from electrodialysis unit 110 until the pH is <9.3) so that the $Mg(OH)_2$ (but not $CaCO_3$) redissolves.

In one embodiment, precipitation unit 106 may be a large vat or tank. In other embodiments precipitation unit 106 may include a series of ponds/pools. In this embodiment, precipitation of calcium salts may occur via evaporation driven concentration (for example using solar ponds) rather than, or in combination with, adding basic substances. Precipitation unit 106 may contain internal structures with a high surface area to promote nucleation of $CaCO_3$; these high surface area structures may be removed from the precipitation unit 106 to collect nucleated $CaCO_3$. Precipitation unit 106 may include an interior with $CaCO_3$ to increase nucleation kinetics by supplying seed crystals. The bottom of precipitation unit 106 may be designed to continually collect and extract precipitate to prevent large quantities of scale buildup.

In another or the same embodiment, heat may be used to aid precipitation. For example solar ponds may be used to heat basified water. In continuously flowing systems, low temperature waste heat solution may be flowed through heat exchange tubes with basified seawater on the outside of the tubes. Alternatively, heating the bottom of precipitation unit 106 may be used to speed up precipitation.

After $CaCO_3$ is precipitated from the water, $CaCO_3$ is transferred to acidification unit 108. In the depicted embodiment, acidification unit 108 is coupled to receive $CaCO_3$ from precipitation unit 106 and coupled to receive aqueous HCl from electrodialysis unit 110. In response to receiving $CaCO_3$ and aqueous HCl, acidification unit 108 produces $CO_2$. In the depicted embodiment, acidification unit 108 is used to evolve $CaCO_3$ into $CO_2$ gas and aqueous $CaCl_2$ according to the following reaction: $CaCO_3$ (s)+2HCl (aq) →$CaCl_2$ (aq)+$H_2O$ (1)+$CO_2$ (g). Reaction kinetics may be increased by agitating/heating the acidified mixture. By adding HCl to $CaCO_3$, $CO_2$ is spontaneously released due to the high equilibrium partial pressure of $CO_2$ gas. This may eliminate the need for membrane contactors or vacuum systems.

Acidification unit 108 is coupled to transport system 198. In the depicted embodiment transport system 198 may be a system of pipes, pumps, chambers, and/or gas cylinders coupled directly between acidification unit 108 and hydrocarbon well 182. However, in other embodiments, transport system 198 may not be directly coupled. In other words, the $CO_2$ extracted from acidification unit 108 may be contained in compress gas cylinders or the like, which are transported to hydrocarbon well 182 to displace the hydrocarbons (e.g., oil and natural gas) from hydrocarbon well 182. However, for purposes of this disclosure it may be said that transport system 198 is "coupled" to both acidification unit 108 and hydrocarbon well 182 even when the $CO_2$ is contained in chambers and trucked to hydrocarbon well 182 for hydrocarbon extraction. Discontinuity in the transport process is contemplated by the claims in the instant application.

In one embodiment, transport system 198 may alter the temperature or the pressure of the $CO_2$ prior to or after transport, so the $CO_2$ is denser than the gas phase of $CO_2$ when the $CO_2$ enters hydrocarbon well 182. To accomplish this, transport system 198 may include compression and dehydration unit 178 to remove water from the $CO_2$ and to change a phase of the $CO_2$ into at least one of a liquid or a supercritical fluid.

$CO_2$ used in EOR is of a purity >95%, and the temperature and pressure of the $CO_2$ is adjusted to ensure that the $CO_2$ is in a denser phase than the gas phase of $CO_2$ (either liquid or supercritical)—for $CO_2$, a supercritical fluid occurs at temperatures greater than 31.1° C., and pressures greater than 7.38 MPa. One noteworthy advantage of system 100A is that producing $CO_2$ from $CaCO_3$ eliminates the need for $N_2O_2$ degassing steps; the $CO_2$ extracted by addition of HCl to $CaCO_3$(s) can be sent directly to compression and dehydration unit 178 to produce the >95% purity liquid or supercritical $CO_2$ appropriate for EOR.

Once all $CO_2$ has been extracted from acidification unit 108, wastewater containing $CaCl_2$ is output from system 100A via $CaCl_2$ output 116. In one embodiment, the wastewater is returned to the ocean or other water source after the pH of the wastewater has been adjusted. In other embodiments, the wastewater is sequestered in hydrocarbon well 182 and used as part of the EOR process (water injection).

In the depicted embodiment, the second portion of seawater (that was used as a carbon source in precipitation unit 106) is flowed to a pH and alkalinity adjustment unit 112. The pH and alkalinity adjustment unit 112 is coupled to electrodialysis unit 110 to receive HCl and NaOH, and adjust a pH and alkalinity of the combined second portion of the aqueous solution and basic solution to a pH and alkalinity of seawater (or other environmentally safe pH value). In one embodiment, the pH and alkalinity of wastewater flowed into pH and alkalinity adjustment unit 112 is monitored in real time, and HCl or NaOH is flowed into pH and alkalinity adjustment unit 112 in response to the real time measurements. Adjusting the pH of wastewater flowing from system 100A ensures minimal environmental impact of running system 100A, while adjusting the alkalinity ensures sufficient reabsorption of atmospheric $CO_2$ once the water is returned to the ocean.

Figure 1B:
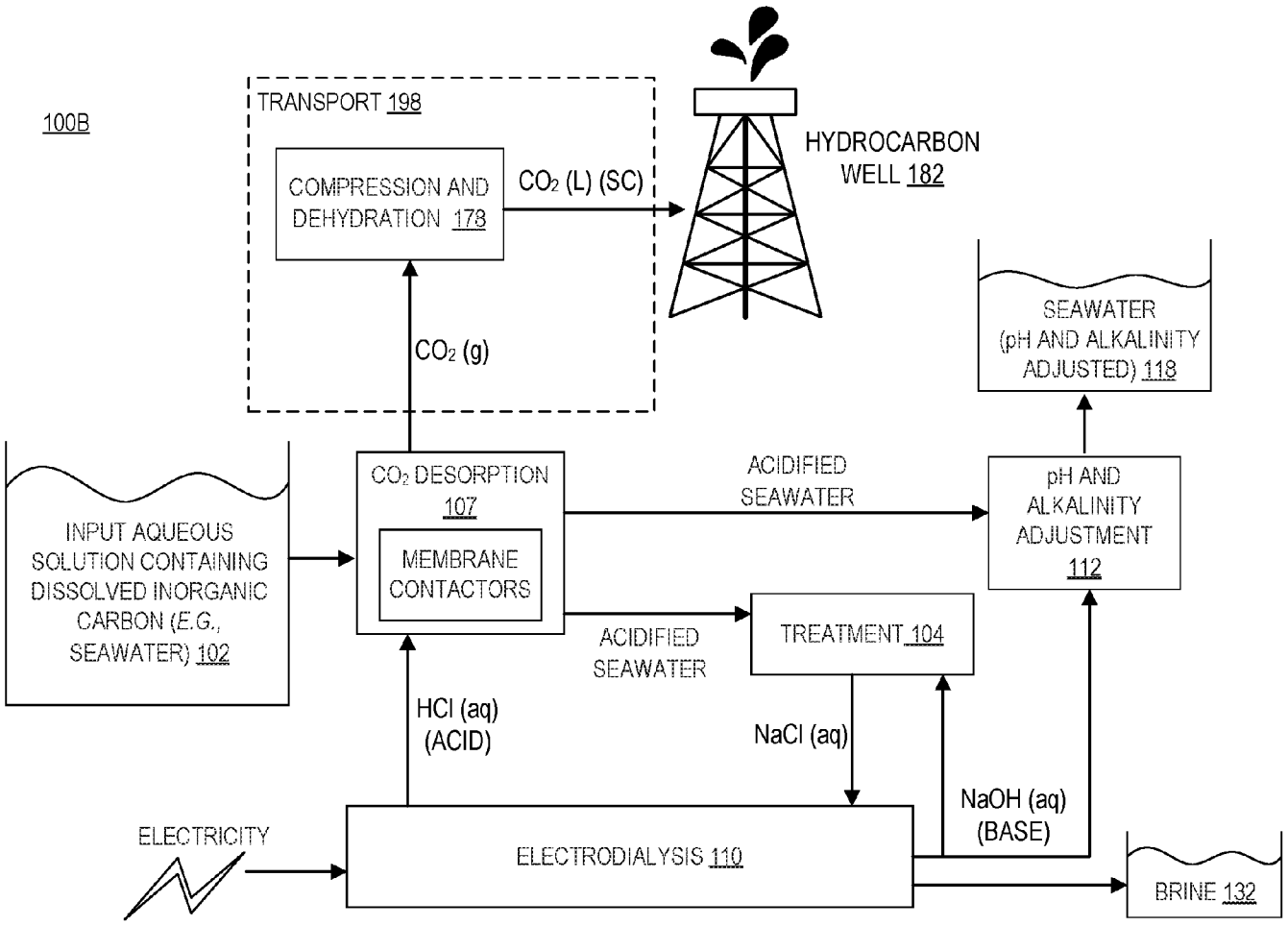
FIG. 1B is an illustration of a system for extracting hydrocarbons from a hydrocarbon well, in accordance with an embodiment of the disclosure.

FIG. 1B is an illustration of system 100B for extracting hydrocarbons from hydrocarbon well 182, in accordance with an embodiment of the disclosure. System 100B is similar in many respects to system 100A of FIG. 1A. However, one major difference is system 100B has degasification unit 107, in lieu of precipitation unit 106 and acidification unit 108.

In the depicted embodiment, electrodialysis unit 110 is coupled to receive aqueous NaCl, and to output aqueous HCl and aqueous NaOH. Degasification unit 107 has a first input coupled to receive an aqueous solution including dissolved inorganic carbon, and a second input coupled to electrodialysis unit 110 to receive the aqueous HCl. In response to receiving the aqueous solution and the aqueous HCl, degasification unit 107 evolves $CO_2$ from the aqueous solution and outputs the aqueous solution. As shown, the aqueous solution may include seawater, and the aqueous NaCl may also be derived, at least in part, from seawater. Degasification unit 107 may include membrane contactors to remove dissolved $N_2$ and $O_2$ gas from the aqueous solution, prior to evolving the $CO_2$ from the aqueous solution. This results in >95% purity $CO_2$ at the outset of the degasification and dehydration process. It is worth noting that in other embodiments, other gases may be extracted from the aqueous solution. Furthermore, any of the processes described above may be vacuum assisted.

Transport system 198 is coupled to degasification unit 107 to transport the $CO_2$ from degasification unit 107 into hydrocarbon well 182 (to displace the hydrocarbons in hydrocarbon well 182). In one embodiment, the transport system 198 alters at least one of a temperature or a pressure of the $CO_2$ either before or after transport so the $CO_2$ is denser than the gas phase of $CO_2$ when the $CO_2$ enters hydrocarbon well 182. In the depicted embodiment, transport system 198 includes compression and dehydration unit 178 to remove water from the $CO_2$ and to change a phase of the $CO_2$ into at least one of a liquid or a supercritical fluid.

Systems 100A-100B may be coupled to, and run by, electronic control systems. Regulation and monitoring may be accomplished by a number of sensors throughout the system that either send signals to a controller or are queried by controller. For example, with reference to electrodialysis unit 110, monitors may include one or more pH gauges to monitor a pH within the units as well as pressure sensors to monitor a pressure among the compartments in electrodialysis unit 110 (to avoid inadvertent mechanical damage to electrodialysis unit 110). Another monitor may be a pH gauge placed within precipitation unit 106 to monitor a pH within the tank. The signals from such pH monitor or monitors allows a controller to control a flow of brine solution (from input 102) and a basified solution (from electrodialysis unit 110) to maintain a pH value of a combined solution that will result in a precipitation of $CaCO_3$.

Alternatively, systems 100A-100B may be controlled manually. For example, a worker may open and close valves to control the various water, acid, and base flows in systems 100A-100B. Additionally, a worker may remove precipitated calcium salts from precipitation unit 106. However, one skilled in the relevant art will appreciate that systems 100A-100B may be controlled by a combination of manual labor and mechanical automation, in accordance with the teachings of the present disclosure.

Figure 2:
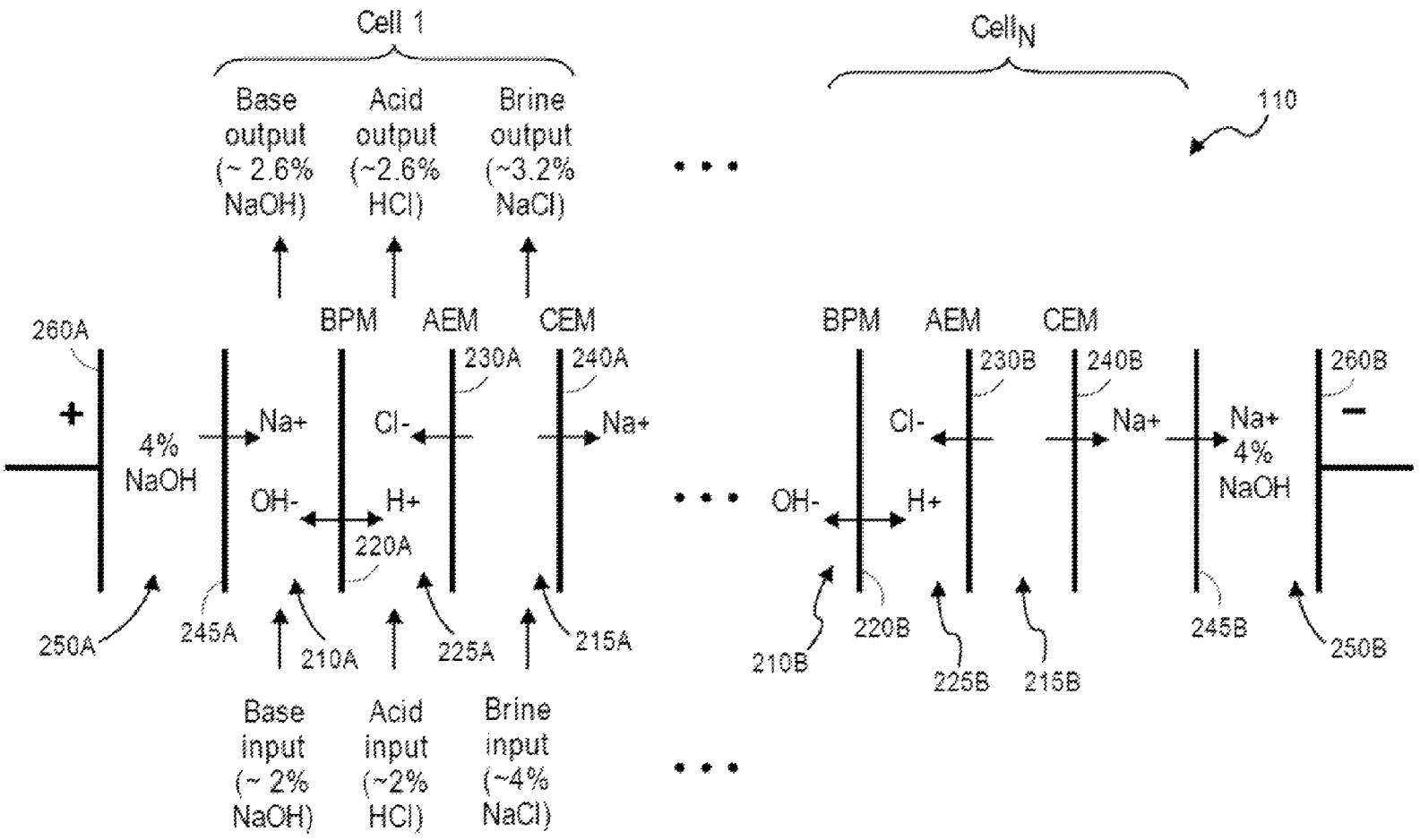
FIG. 2 is an example electrodialysis unit, in accordance with an embodiment of the disclosure.

FIG. 2 is an example electrodialysis unit 110 (e.g., electrodialysis unit 110 of FIG. 1A-1B), in accordance with an embodiment of the disclosure. Electrodialysis unit 110 may be used to convert seawater (or other NaCl-containing aqueous solutions) into NaOH and HCl. As shown, in FIGS. 1A-1B, NaOH and HCl may be used to adjust the pH of the aqueous solution to precipitate calcium salts and evolve $CO_2$ gas. In one embodiment electrodialysis unit 110 is a bipolar membrane electrodialysis unit.

In the depicted embodiment, electrodialysis unit 110 representatively consists of several cells in series, with each cell including a basified solution compartment (compartments 210A and 210B illustrated); an acidified solution compartment (compartments 225A and 225B illustrated); and a brine solution compartment (compartments 215A and 215B). FIG. 2 also shows a bipolar membrane (BPM) between a basified solution compartment and an acidified solution compartment (BPM 220A and 220B illustrated). A suitable BPM is a Neosepta BP-1E, commercially available from Ameridia Corp. Also depicted are anion exchange membranes (AEM), such as Neosepta ACS (commercially available from Ameridia Corp.), disposed between a brine compartment and an acidified solution compartment (AEM 230A and 230B illustrated). A cation exchange membrane (CEM) such as Neosepta CMX-S (commercially available from Ameridia Corp.), is disposed adjacent to a brine compartment (CEM 240A and CEM 240B illustrated). Finally, FIG. 2 shows end cap membranes 245A and 245B (such as Nafion® membranes) that separate the membrane stack from electrode solution compartment 250A and electrode solution compartment 250B, respectively.

Broadly speaking, under an applied voltage provided to electrodialysis unit 110, water dissociation inside the BPM (and the ion-selective membranes comprising a BPM) will result in the transport of hydrogen ions (H+) from one side of the BPM, and hydroxyl ions (OH−) from the opposite side. AEMs/CEMs, as their names suggest, allow the transport of negatively/positively charged ions through the membrane. The properties of these membranes such as electrical resistance, burst strength, and thickness are provided by the manufacturer (e.g., Neosepta ACS and CMX-S are monovalent-anion and monovalent-cation permselective membranes, respectively). In one embodiment, electrodialysis unit 110 includes electrodes 260A and 260B of, for example, nickel manufactured by De Nora Tech Inc. FIG. 2 also shows electrode solution compartment 250A and electrode solution compartment 250B through which, in one embodiment, a NaOH(aq) solution is flowed. Where electrode 260A is a positively-charged electrode, sodium ions (Na+) will be encouraged to move across cap membrane 245A and where electrode 260B is negatively-charged, sodium ions will be attracted to electrode solution compartment 250B. In one embodiment, the solution compartments between adjacent membranes are filled with polyethylene mesh spacers (e.g., 762 μm thick polyethylene mesh spacers), and these compartments are sealed against leaks using axial pressure and 794 mm thick EPDM rubber gaskets.

Figure 3:
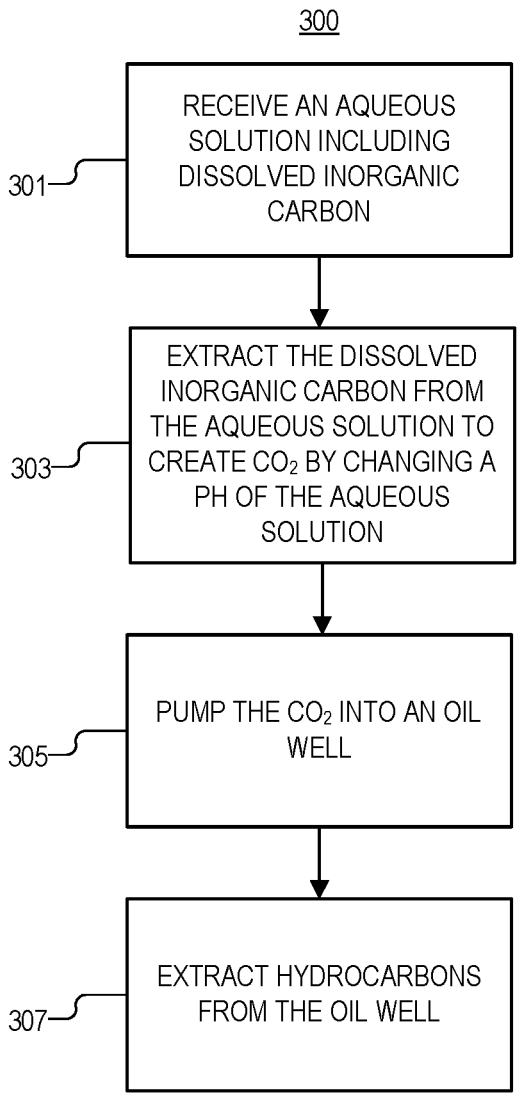
FIG. 3 is an illustration of a method for extracting hydrocarbons from a hydrocarbon well, in accordance with an embodiment of the disclosure.

FIG. 3 is a flow chart illustrating a method 300 for extracting hydrocarbons from a hydrocarbon (oil and/or natural gas) well, in accordance with an embodiment of the disclosure. The order in which some or all of process blocks 301-307 appear in method 300 should not be deemed limiting. Rather, one of ordinary skill in the art having the benefit of the present disclosure will understand that some of method 300 may be executed in a variety of orders not illustrated, or even in parallel. Additionally, method 300 may include additional blocks or have fewer blocks than shown, in accordance with the teachings of the present disclosure.

Block 301 illustrates receiving an aqueous solution including dissolved inorganic carbon. In one embodiment, the aqueous solution includes seawater containing bicarbonate ions ($HCO_3$—).

Block 303 discloses extracting the dissolved inorganic carbon from the aqueous solution to create $CO_2$ by changing a pH of the aqueous solution. In one embodiment this may include increasing the pH of the aqueous solution to precipitate salts containing carbon, and applying acid to the salts to evolve $CO_2$ gas. This process may include adding aqueous NaOH to the aqueous solution (to increase the pH), and applying HCl to the salts (to evolve the $CO_2$). In an alternate embodiment, extracting the dissolved inorganic carbon includes decreasing the pH of the aqueous solution to remove $CO_2$ gas from the aqueous solution. In this embodiment, decreasing the pH includes adding aqueous HCl to the aqueous solution, and the aqueous HCl is produced by an electrodialysis unit. Further, $N_2$ and $O_2$ may be removed from the aqueous solution before decreasing the pH of the aqueous solution.

Block 305 shows pumping the $CO_2$ into the hydrocarbon well. In one embodiment, the density of the $CO_2$ may be altered to be greater than the density of $CO_2$ gas by adjusting the temperature or and/or pressure. Thus, the $CO_2$ pumped into the well may be a liquid or a supercritical fluid of greater than 95% purity.

Block 307 illustrates extracting the hydrocarbons from the hydrocarbon well, in response to pumping $CO_2$ into the well. The $CO_2$ may mix with and/or displace hydrocarbons (e.g., oil or natural gas) in the well, resulting in their migration towards the surface. $CO_2$ injection into a hydrocarbon well is a miscible displacement process. A miscible displacement process may maintain pressure in the well and improve oil displacement due to reduced interfacial tension between oil and water in the well. Carbon dioxide may be best suited for miscible displacement because it reduces oil viscosity, and may be less expensive than other gases.

In the case of $CO_2$ EOR, the first step includes injecting water into the well. In one embodiment this may include wastewater from the $CO_2$ extraction process. Once the reservoir is pressurized with water, $CO_2$ is pumped down into the well. The $CO_2$ gas then comes in contact with the oil. The oil-$CO_2$ contact area creates a miscible zone that is easily moved/extracted. In some instances, oil field workers may alternate between injection of $CO_2$ and water, because water helps sweep oil towards the production area. Method 300 disclosed here may be used for producing $CO_2$ in places where there is ample seawater but no $CO_2$ supply chain. Thus, method 300 may enable the recovery of millions of barrels of otherwise inaccessible oil.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A method of extracting hydrocarbons from a hydrocarbon well, comprising:

receiving an aqueous solution including dissolved inorganic carbon with a carbon extraction unit;

extracting the dissolved inorganic carbon from the aqueous solution to create $CO_2$ by changing a pH of the aqueous solution, wherein changing the pH includes receiving, with the carbon extraction unit, aqueous NaOH or aqueous HCl from an electrodialysis unit coupled to the carbon extraction unit;

pumping the aqueous solution from the carbon extraction unit into the hydrocarbon well after extracting the dissolved inorganic carbon from the aqueous solution;

pumping the $CO_2$ into the hydrocarbon well; and in response to pumping the $CO_2$ into the hydrocarbon well, extracting the hydrocarbons from the hydrocarbon well.

2. The method of claim 1, wherein extracting the dissolved inorganic carbon includes:

increasing the pH of the aqueous solution to precipitate salts containing carbon; and applying acid to the salts to evolve $CO_2$ gas.

3. The method of claim 2, wherein increasing the pH includes adding aqueous NaOH to the aqueous solution, and wherein applying the acid to the salts includes applying aqueous HCl to the salts.

4. The method of claim 1, wherein extracting the dissolved inorganic carbon includes decreasing the pH of the aqueous solution to remove $CO_2$ gas from the aqueous solution.

5. The method of claim 4, wherein decreasing the pH includes adding aqueous HCl to the aqueous solution, wherein the aqueous HCl is produced by an electrodialysis unit.

6. The method of claim 5, further comprising removing $N_2$ and $O_2$ from the aqueous solution before decreasing the pH of the aqueous solution.

7. The method of claim 1, further comprising:

receiving the $CO_2$ from the carbon extraction unit with a compression and dehydration unit coupled to the carbon extraction unit; and altering the density of the $CO_2$ with the compression and dehydration unit to be greater than a density of $CO_2$ gas by adjusting at least one of a temperature or a pressure.

8. The method of claim 7, wherein pumping the $CO_2$ into the hydrocarbon well includes outputting the $CO_2$ from the compression and dehydration unit into the hydrocarbon well, wherein the compression and dehydration unit is coupled to the hydrocarbon well, and the $CO_2$ pumped into the hydrocarbon well is at least one of a liquid or a supercritical fluid.

9. The method of claim 1, wherein the $CO_2$ is greater than 95% pure.

10. The method of claim 1, further comprising filtering the aqueous solution, including sea water, with a treatment unit coupled to the electrodialysis unit to remove ions and organic matter from the sea water.

11. The method of claim 1, wherein the electrodialysis unit is coupled to perform operations comprising:

receiving the aqueous solution with a brine solution compartment disposed in the electrodialysis unit;

applying a voltage across electrodes in the electrodialysis unit;

outputting the aqueous solution from the brine solution compartment with a lower salt concentration in response to the voltage applied across the electrodes;

receiving the aqueous HCl with an acidified solution compartment disposed in the electrodialysis unit;

applying the voltage across the electrodes in the electrodialysis unit; and outputting the aqueous HCl, with a higher HCl concentration, from the acidified solution compartment, wherein chlorine ions in the brine solution compartment traveled to the acidified solution compartment in response to the voltage across the electrodes.

12. The method of claim 11, wherein the electrodialysis unit is coupled to perform operations further comprising:

receiving the aqueous NaOH with a basified compartment disposed in the electrodialysis unit;

applying the voltage across the electrodes in the electrodialysis unit; and outputting the aqueous NaOH from the basified solution compartment with a higher NaOH concentration in response to the voltage applied across the electrodes.

13. The method of claim 12, wherein in response to the voltage, the chlorine ions flow through an anion exchange membrane disposed between the brine solution compartment and the acidified solution compartment, and wherein in response to the voltage, hydrogen ions and hydroxyl ions flow through a bipolar membrane disposed between the acidified solution compartment and the basified solution compartment.

14. The method of claim 13, wherein applying the voltage across the electrodes in the electrodialysis unit includes collecting sodium ions at a negatively charged terminal, and wherein the brine solution compartment, the acidified solution compartment, and the basified solution compartment are included in a first cell in a plurality of cells in the electrodialysis unit.

15. The method of claim 14, further comprising neutralizing the aqueous solution, in a pH and alkalinity adjustment unit coupled to the electrodialysis unit, with the aqueous NaOH or the aqueous HCl, after extracting the dissolved inorganic carbon from the aqueous solution.

16. The method of claim 8, further comprising directly outputting the $CO_2$ from the compression and dehydration unit into the hydrocarbon well without degassing $O_2$ gas or $N_2$ gas from the $CO_2$.

* * * * *